US006234711B1

(12) United States Patent
Beaman

(10) Patent No.: US 6,234,711 B1
(45) Date of Patent: May 22, 2001

(54) CURB AND GUTTER FRAME AND FUNNEL DRAIN

(76) Inventor: Donald B. Beaman, Rte. 4, Box 495, Snow Hill, NC (US) 28580

( * ) Notice: Subject to any disclaimer, the term of this patent is extended or adjusted under 35 U.S.C. 154(b) by 0 days.

(21) Appl. No.: 09/359,748

(22) Filed: Jul. 23, 1999

(51) Int. Cl.[7] ..... E01C 11/22; E01F 5/00

(52) U.S. Cl. ..... 404/4; 404/2; 52/19; 52/20; 249/2; 249/8

(58) Field of Search ..... 249/2, 4, 8, 10; 52/20, 19, 21; 404/2, 4, 5, 74

(56) References Cited

U.S. PATENT DOCUMENTS

| | | | | |
|---|---|---|---|---|
| 125,118 | * | 4/1872 | Chase et al. . | |
| 329,404 | | 10/1885 | McConnell . | |
| 783,740 | | 2/1905 | Barker . | |
| 1,473,551 | | 11/1923 | Gschwind . | |
| 1,664,853 | | 4/1928 | Firth . | |
| 2,518,620 | * | 8/1950 | Hughes . | |
| 2,537,654 | | 1/1951 | Curnutte . | |
| 2,809,414 | | 10/1957 | Mitchell . | |
| 3,347,514 | * | 10/1967 | Yates . | |
| 3,436,051 | * | 4/1969 | Nakahara . | |
| 3,844,073 | * | 10/1974 | Peletz | 52/20 |
| 4,061,434 | * | 12/1977 | Carroll | 404/4 |
| 4,192,625 | * | 3/1980 | Peletz | 404/5 |
| 4,241,543 | * | 12/1980 | Foscarini et al. | 52/741.11 |
| 4,321,024 | * | 3/1982 | Terraillon . | |
| 4,610,566 | | 9/1986 | Albang et al. . | |
| 4,637,585 | * | 1/1987 | Picollo | 249/10 |
| 4,844,403 | * | 7/1989 | Castle | 249/10 |
| 4,957,268 | * | 9/1990 | Picollo et al. | 249/10 |
| 4,986,693 | | 1/1991 | Salberg et al. . | |
| 5,720,467 | * | 2/1998 | Del Zotto | 249/155 |

* cited by examiner

*Primary Examiner*—Thomas B. Will
*Assistant Examiner*—Gary S. Hartmann
(74) *Attorney, Agent, or Firm*—Jacobson, Price, Holman & Stern, PLLC

(57) ABSTRACT

A prefabricated one-piece metal frame and funnel drain is constructed for curb and gutter use. The frame may be constructed in a number of styles, with a particular style selected to match the desired curb form. The funnel drain also includes a variety of styles in order to accommodate different drain pipe orientations and configurations. When welded together, the frame and funnel drain may be mounted within any standard curb and gutter form such that curb and gutter installation and drain pipe installation may be accomplished simultaneously, without any preparatory concrete work required for placement of the frame and funnel drain.

23 Claims, 16 Drawing Sheets

CURB AND GUTTER FRAME AND FUNNEL DRAIN

BACKGROUND OF THE INVENTION

1. Field of the Invention

The present invention relates to drain outlets for public streets and roadways. More particularly, the present invention relates to a curb and gutter frame and funnel drain structure that may be installed in conjunction with standard concrete curb and gutter forms and that can be adapted to accommodate a variety of underground drain pipe configurations.

2. Description of the Related Art

In the prior art representatively shown in FIGS. 1 and 2, standard cast iron grates 100 and frames 102 are installed with curbs and gutters in a two-step process. Prior to the pouring of the curb 104, brick masons construct a masonry chimney 106 directly over the drain pipe 108 for each frame and grate. When the appropriate elevation of each masonry chimney 106 is reached, a cast iron frame 102 and grate 100 is mounted thereon. When this work is completed, the standard curb and gutter forms are set around the frame and grate. Because this work is done in two steps, it is difficult to match the elevations of the masonry work with the drain slopes.

Furthermore, when pouring the concrete in the curb form, a section of the form must be left open on either side of the frame and grate due to the fact that a standard curb and gutter paving machine cannot pave over the previously installed cast iron frame and grate. As a result, the sections 110 on either side of the frame 102 and grate 100 must be hand troweled in by a later process. This not only incurs additional labor and expense, but also creates an expansion joint 112 in the paving near the grate. This joint near the grate is often a weak area that may separate under heavy loads.

Representative prior art is shown in U.S. Pat. Nos. 329,404, 783,740, 1,473,551, 1,664,853, 2,537,654, 2,809,414, 4,610,566, and 4,986,693.

SUMMARY OF THE INVENTION

In view of the foregoing, it is an object of the present invention to provide a one-piece curb and gutter frame and funnel drain that can be installed directly in a standard concrete curb and gutter form with the frame having the same upper profile as the form, enabling a standard curb and gutter paving machine to pour the curb with the frame and funnel drain in place in the form, thus eliminating the need to hand trowel on either side of the curb and gutter frame.

Another object of the invention is a frame and grate that may be installed without prior concrete work or preparation, and which can be installed concurrently with pouring of the curb and gutter.

A further object of the invention is a curb and gutter funnel drain oriented in non-vertical alignment with the frame and grate, allowing future repair to the drain without disturbance to the adjacent street and curb.

A still further object of the invention is a frame and funnel drain structure that can be adapted to accommodate a variety of drain pipe connection configurations.

In accordance with the foregoing and other objects, the present invention comprises a metal frame and funnel drain fabricated into a single welded structure. The funnel drain can be constructed in a number of ways so as to accommodate any type or shape of curb and gutter funnel outlet. The funnel drain is compatible with a full line of bolt-on attachments, including elbows, funnel extensions and saddle fittings, which connect to each other with standard corrugated metal pipe hugger bands. Through selection and adjustment of these attachments, the funnel drain may be effectively connected to a variety of drain pipe configurations, including those offset so as to be out of vertical alignment with the frame.

In addition to the adaptability of the configuration of the one-piece frame and funnel drain to fit various pipe orientations, the one-piece frame and funnel drain of the present invention also offers advantages in installation. The one-piece frame and funnel drain may be installed within any standard curb and gutter form. When installed in a curb and gutter form of the same style as the frame, a standard curb and gutter paving machine can pave directly up to the side panels of the frame. Furthermore, no preparatory concrete work is required to install the frame and funnel drain unit. Instead, concrete is poured with the one-piece unit in the form, so that curb and gutter installation and drain pipe installation may be accomplished simultaneously, saving both time and money over prior art methods.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
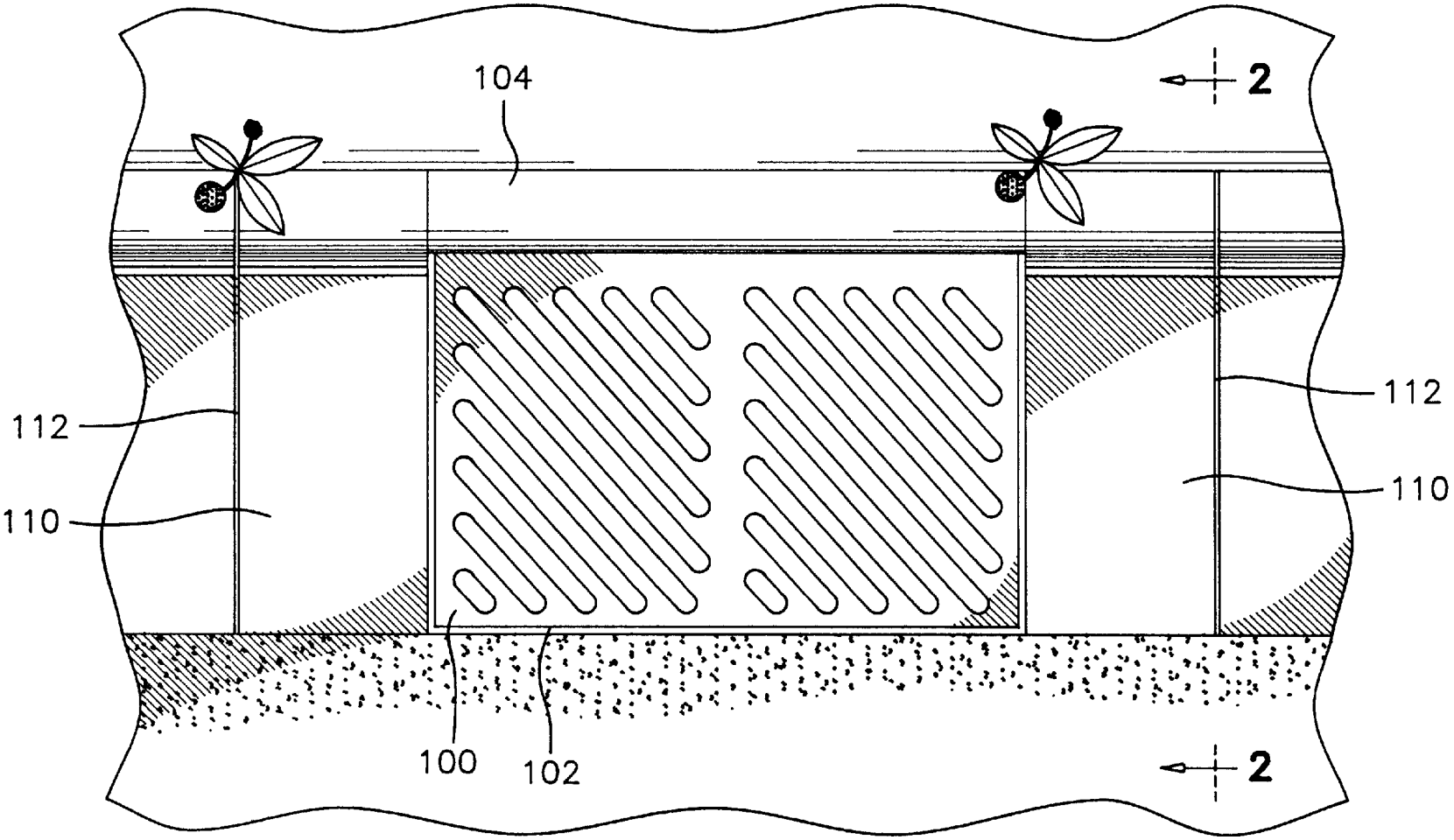
FIG. 1 (PRIOR ART)
FIG. 1 is a top view of a prior art cast iron grate and frame as installed in a curb.
Figure 2:
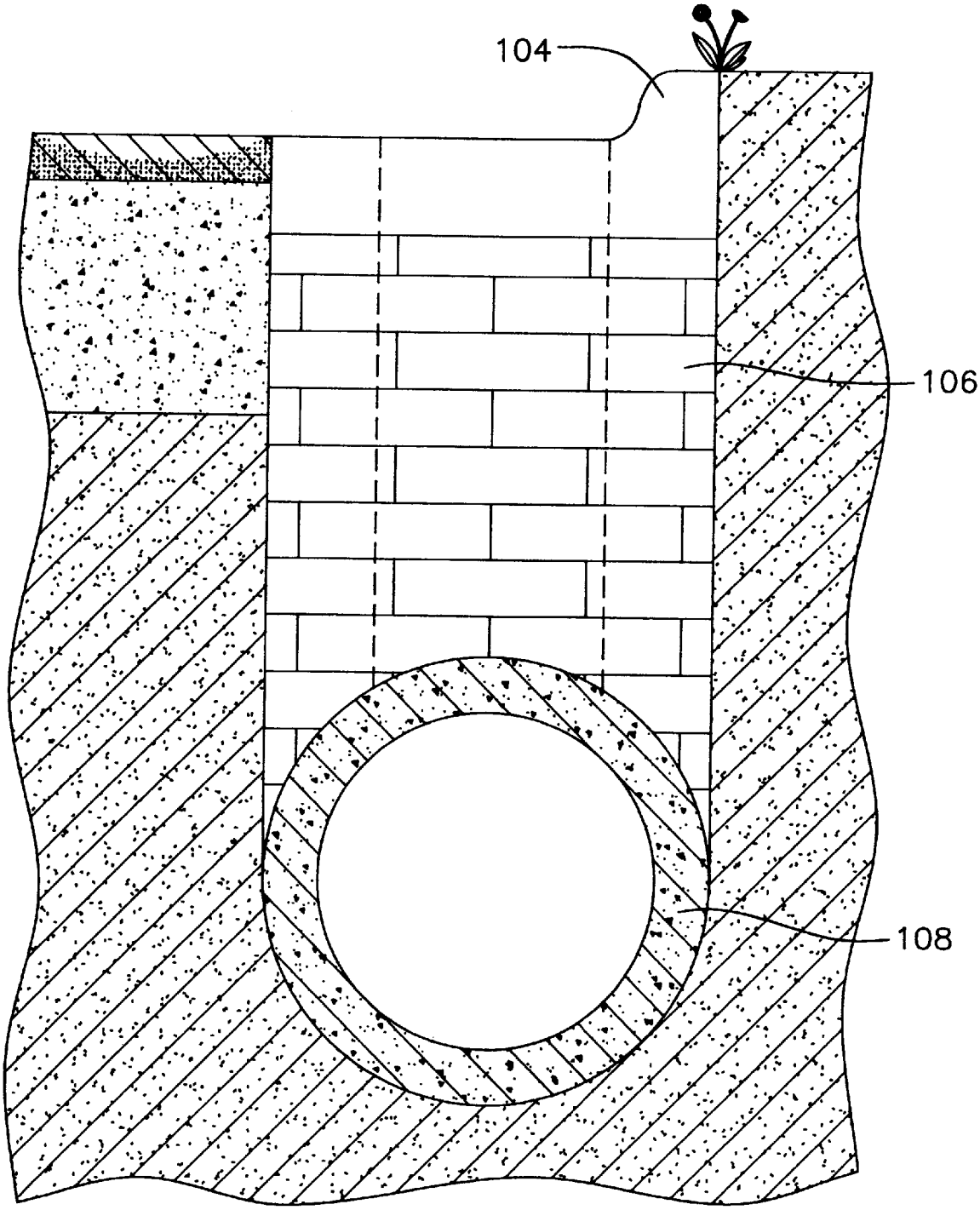
FIG. 2 (PRIOR ART)
FIG. 2 is a cross-sectional view along line 2—2 in FIG. 1 showing the prior art brick masonry base as built upon a drainage pipe to support the iron grate and frame.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 3:
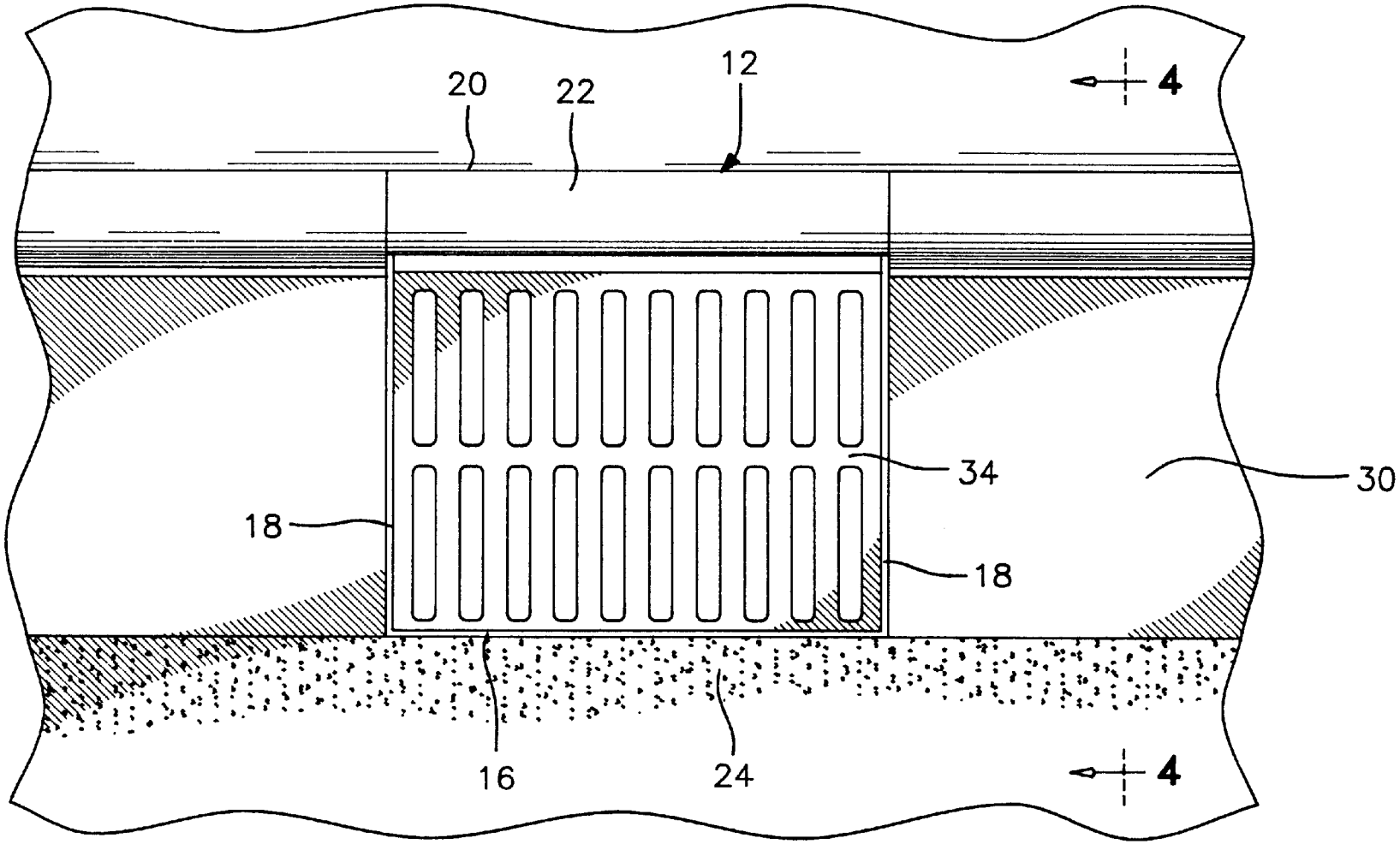
FIG. 3 is a top view of a one-piece frame and funnel drain in accordance with the present invention, as installed in a standard curb with a grate in place.
Figure 4:
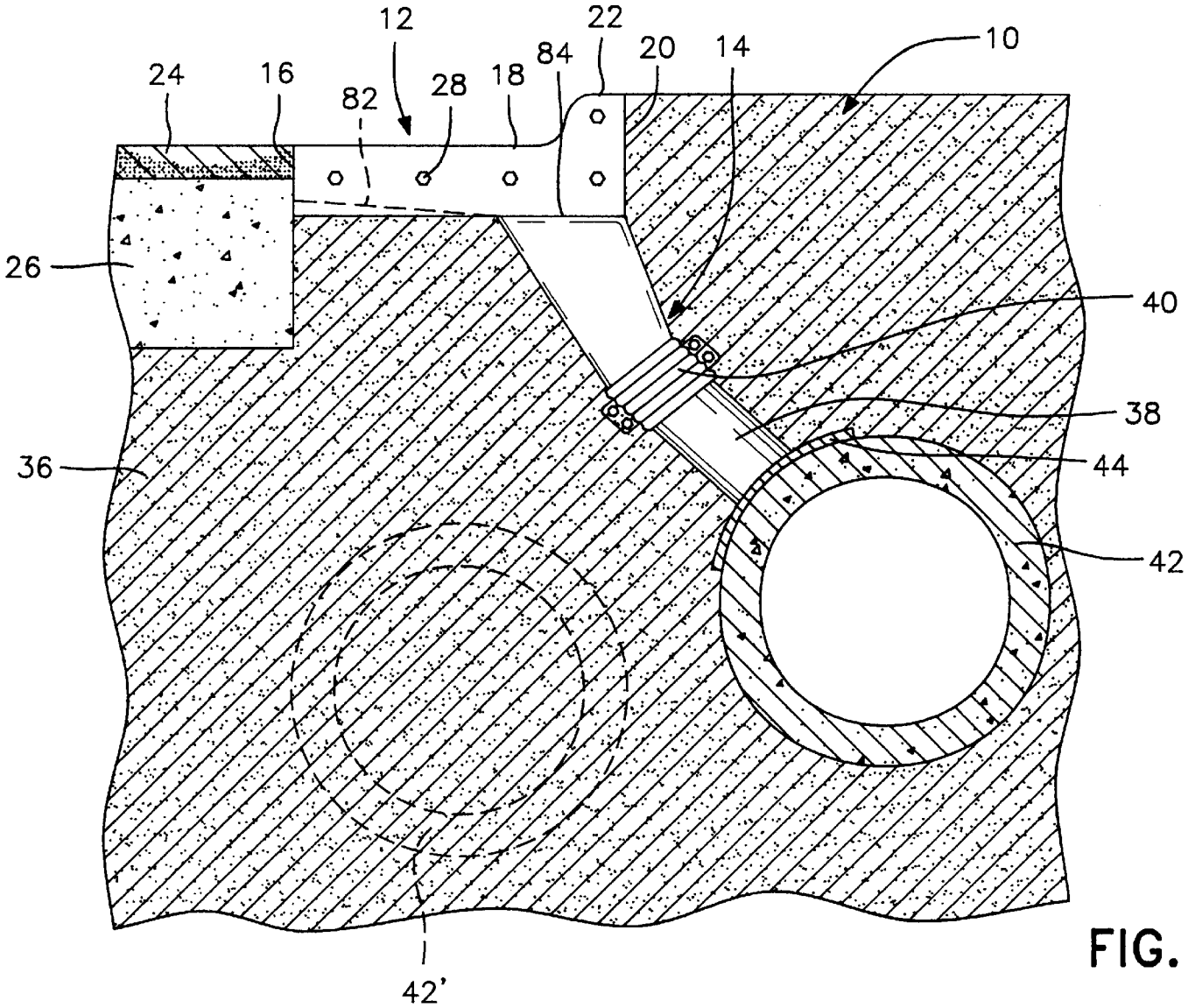
FIG. 4 is a cutaway side view along line 4—4 in FIG. 3 showing the one-piece frame and funnel drain as installed, with a funnel extension connected to a drainage pipe with a saddle fitting.

Referring now more specifically to the drawings, FIGS. 3 and 4 illustrate a preferred embodiment of the one-piece curb and gutter frame and funnel drain of the present invention, generally designed by the reference numeral 10. A frame, generally designated by the reference numeral 12, is fixedly connected to a funnel drain, generally designated by the reference numeral 14. In each of the preferred embodiments discussed herein, the frame 12 and funnel drain 14 are preferably constructed of welded steel with a galvanized coating to ensure long life. As used herein, "funnel drain" is intended to refer generally to any drain which may be welded to the frame in accordance with the present invention and thus is not limited to drains having a customary "funnel" shape.

The frame 12 has a front panel 16, two side panels 18 and a rear panel 20. The rear panel 20 is taller than the front panel 16 in order to form a curb. Each side panel 18 rises upwardly near the rear panel 20; the slope of the rise varies depending on the curb form being matched by the frame 12. A curb hood 22 is formed between the uppermost rear surfaces of each side panel 18 and the top of the rear panel 20, extending toward the front panel, and having a shape and curvature consistent with the style of curb within which the particular one-piece unit 10 is intended to be installed.

The front panel 16 abuts the road surface 24 and gravel base 26 being drained by the one-piece frame and funnel drain 10. A connecting structure such as a plurality of reinforcement studs 28 extend outwardly from each side panel 18 of the frame 12 in order to secure the frame 12 to the concrete paving 30. In the preferred embodiments, these studs 28 comprise welded rebar pegs; however, other connecting elements can be used in accordance with the present invention. While not shown in FIG. 4, the frame also preferably includes a plurality of dowels 32 extending outwardly from the front panel 16 and the rear panel 20 of the frame for securing the frame to a curb and gutter form when pouring the concrete. Other structures for securing the frame in the form could also be used.

A grate 34 may be installed on the upper side of the frame 12. Alternatively, the upper side of the frame 12 may be contoured with concrete as described more fully hereinafter. In the embodiment shown in FIGS. 3 and 4, the bottom of the frame has a sloped drain surface 82, to the rear of which is a frame drain opening 84. The frame drain opening 84 is accessible to the funnel drain 14 below and is normally directly above the top of the funnel drain 14. In this embodiment, no concrete contouring is necessary and the upper side of the frame supports the grate 34.

The funnel drain 14 shown in FIG. 4 is a sloped and tapered funnel drain that extends downwardly and rearwardly from the underside of the frame 12 into the supporting earth 36. The upper end of the funnel drain 14 is fixedly connected to the underside of the frame 12. Points of connection with the underside of the frame 12 preferably include the lower edge of the rear panel 20, lower edge portions of the side panels 18, and/or the bottom surface 82. The funnel drain 14 is connected to the underside of the frame preferably by welding, but other suitable techniques for joining metal objects can also be used. During manufacture, the funnel drain can be welded to the frame at any angle to accommodate particular construction needs. Alternatively, the frame 12 and funnel drain 14 can be manufactured separately and then bolted together prior to or during installation in the field. With such a bolting arrangement, variation in the angle between the frame and the funnel drain can be accommodated through alternative bolt positions.

A particular advantage to the sloped and tapered funnel drain 14 is that it allows the drain pipe to be out of vertical alignment with the frame and funnel drain 10 and associated concrete paving. By offsetting of the drain pipe, the funnel drain may be connected to the drain pipe after the curb has been poured. In addition, many future repairs to the drain system may be effected without disturbing the adjacent street and curb.

A funnel extension 38 is coupled to the lower end of the funnel drain 14 with a connector band 40. The other end of the funnel extension 38 is connected to a drainage pipe 42 using a saddle fitting 44. Variation in the positioning of the drainage pipe 42, shown by dotted lines as drainage pipe 42', may be accommodated by orienting the funnel drain 14 differently, relative to the frame 12, when initially connecting the drain 14 to the frame 12 to construct the one-piece frame and funnel drain 10. Drainage pipe 42' may also be accommodated through the use of a variety of funnel extensions and attachments, such as shown in FIG. 5.

Figure 5:
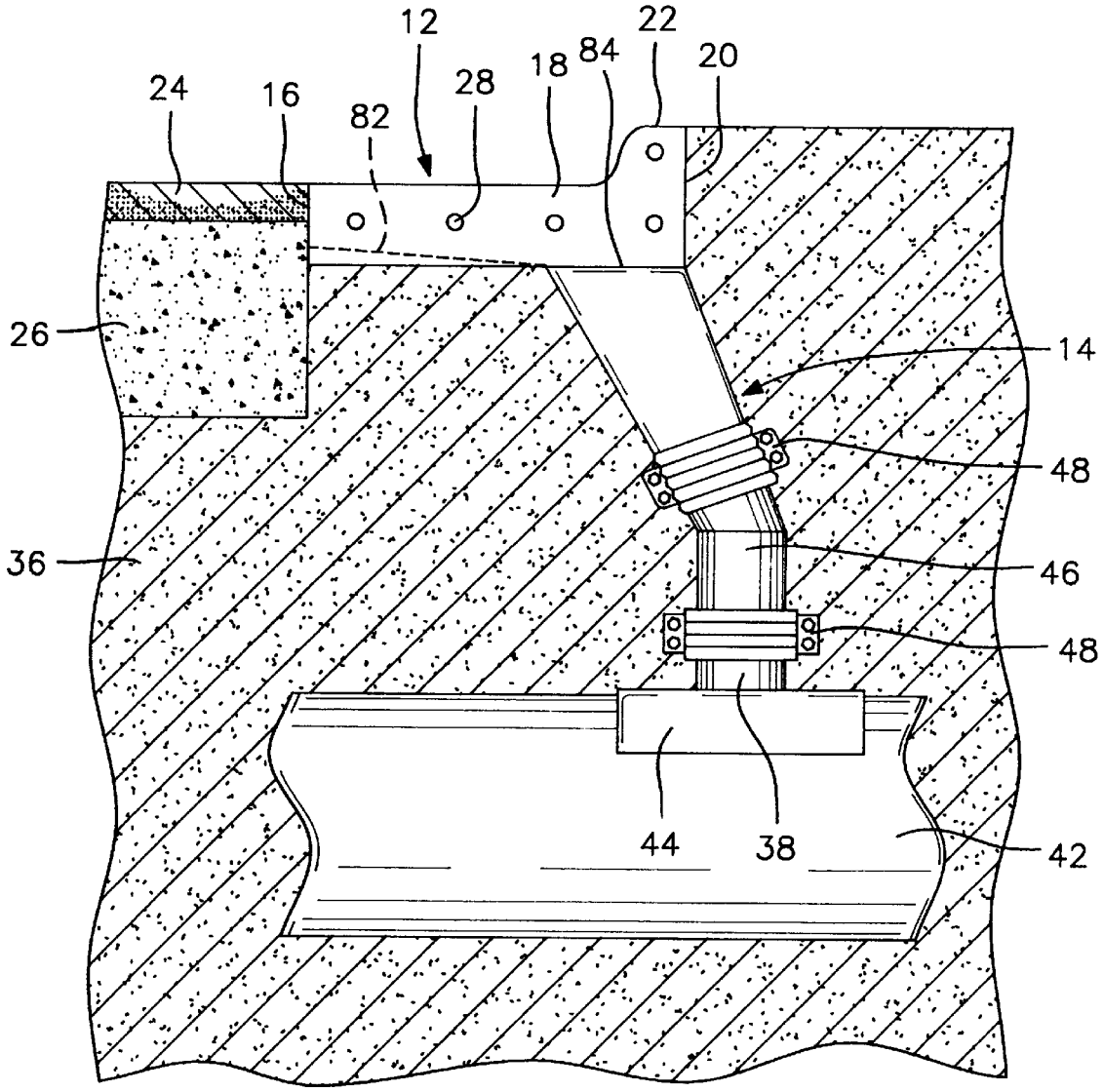
FIG. 5 is a cutaway side view along line 4—4 in FIG. 3 showing the one-piece frame and funnel drain as installed, with an alternate funnel extension orientation.

Looking now to FIG. 5, an elbow fitting 46 may be connected between the lower end of the funnel drain 14 and the funnel extension 38, and secured with hugger bands 48. Other structures suitable for connecting the fitting and drain structures may also be used.

Figure 6A:
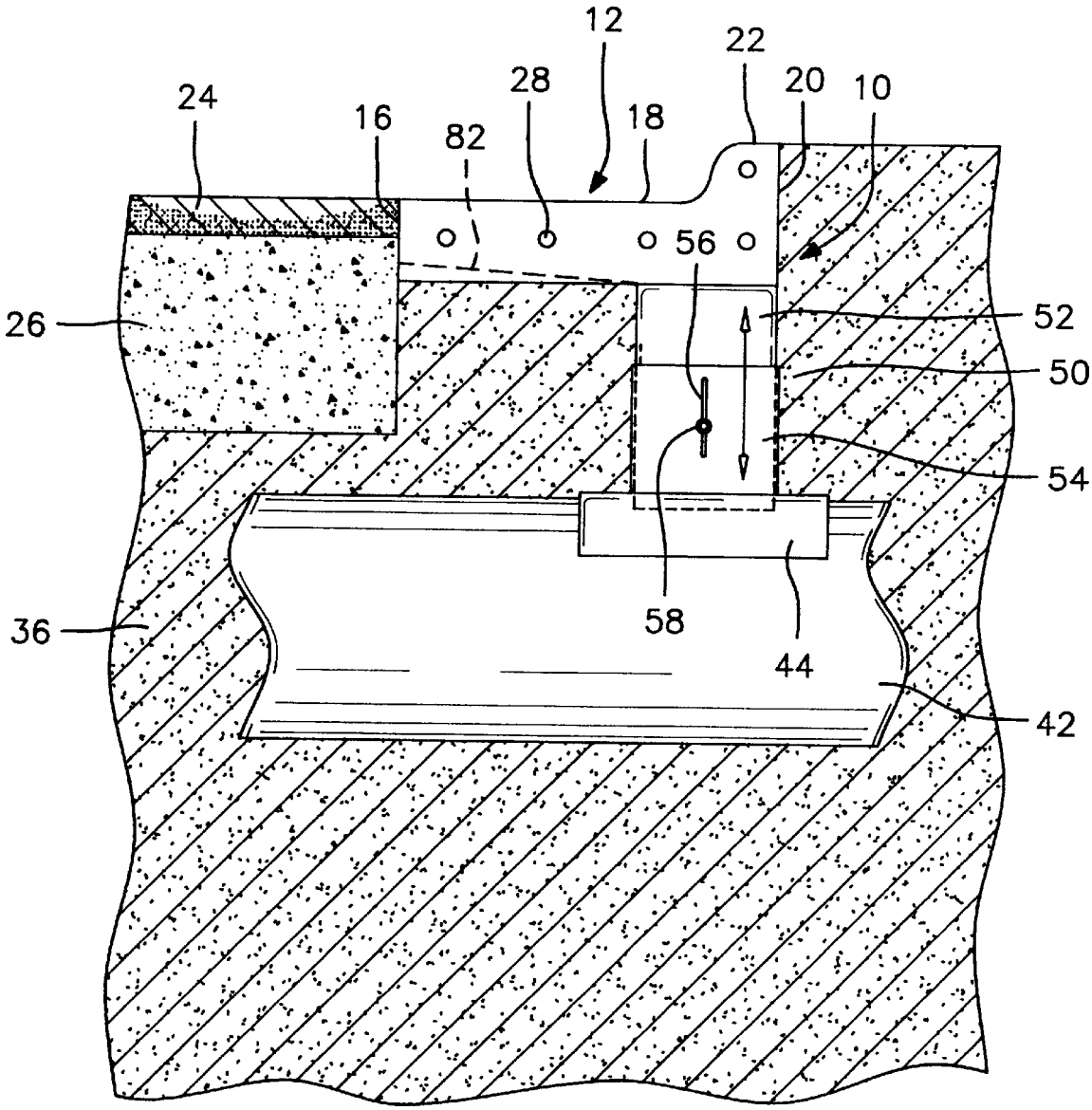
FIG. 6A is a cutaway side view along line 4—4 in FIG. 3 showing another alternative construction of the one-piece frame and funnel drain as installed, the frame having an extendable rectangular sleeve fitting welded thereto which is connected to a drainage pipe with a saddle fitting.
Figure 6B:
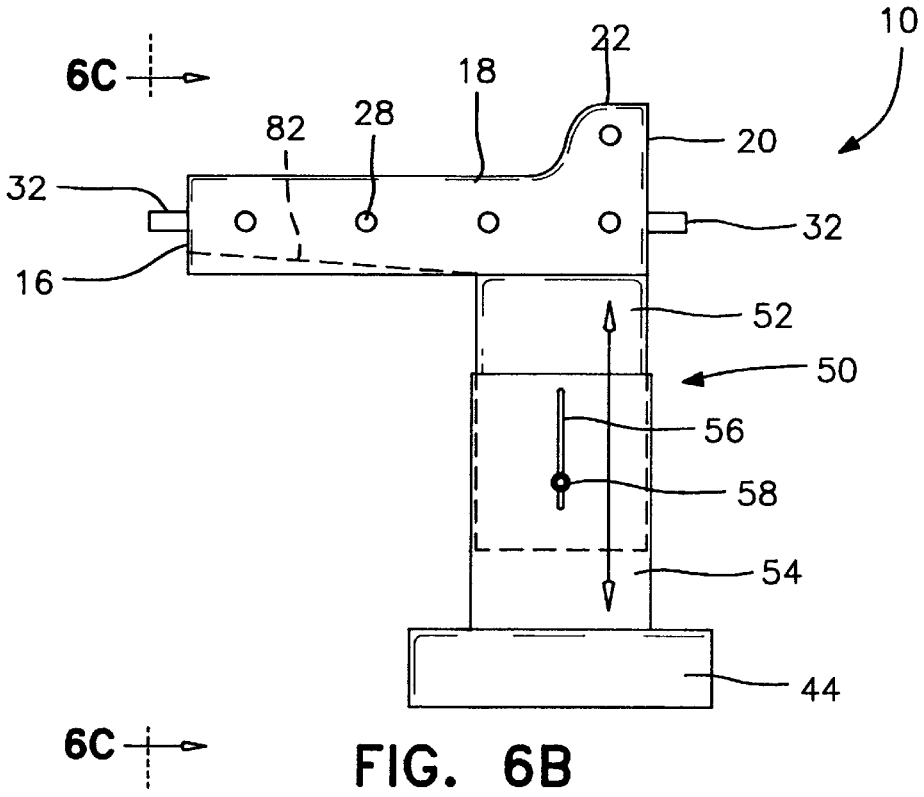
FIG. 6B is a side view of the alternative construction of the one-piece frame and funnel drain of FIG. 6A.
Figure 6C:
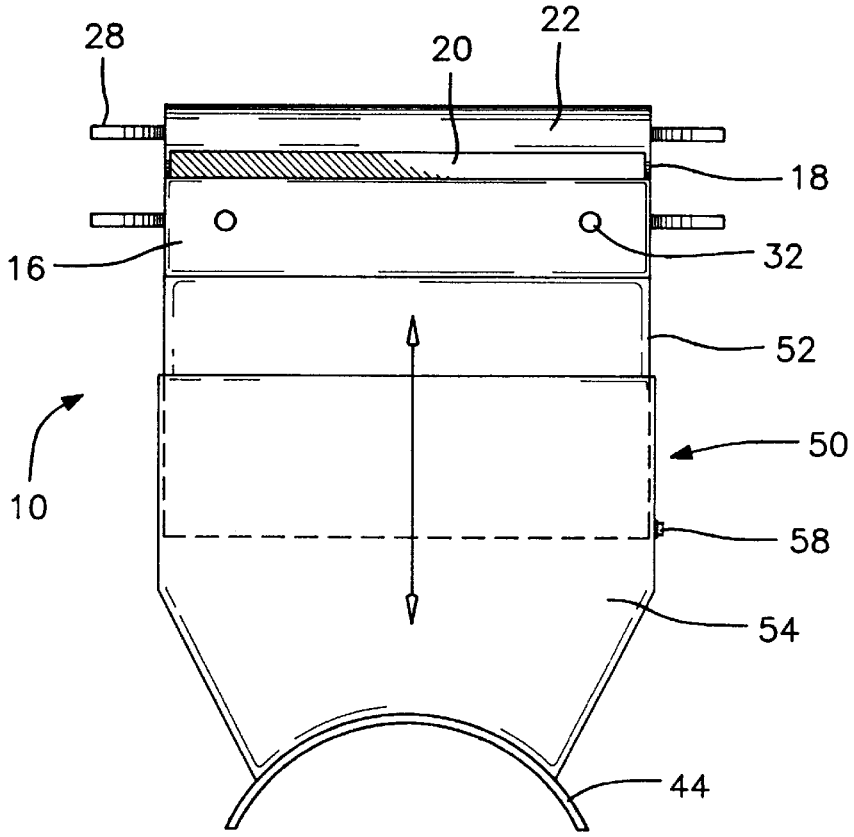
FIG. 6C is a front view of the alternative construction of the one-piece frame and funnel drain of FIG. 6B.

An alternative embodiment of the one-piece frame and funnel drain 10 is shown in FIGS. 6A–6C. An extendable rectangular sleeve fitting, generally designated by the reference numeral 50, is welded to the frame 12 and acts as the funnel drain. The extendable rectangular sleeve 50 has an inner portion 52 and an outer portion 54. The outer portion 54 is sized to receive the inner portion 52 and includes a slot 56.

In this alternative embodiment, the inner portion 52 is welded to the underside of the frame 12, preferably at an angle approximately perpendicular thereto. The outer portion 54 tapers at the bottom and is connected to the drainage pipe 42 with a saddle fitting 44. The depth of insertion of the inner portion 52 within the outer portion 54, and hence the distance between the underside of the frame 12 and the drainage pipe 42, is adjustable. When the inner portion 52 is at the desired insertion depth, the bolt 58 that passes through the slot 56 is tightened to secure the inner portion 52 against the outer portion 54.

Figure 7A:
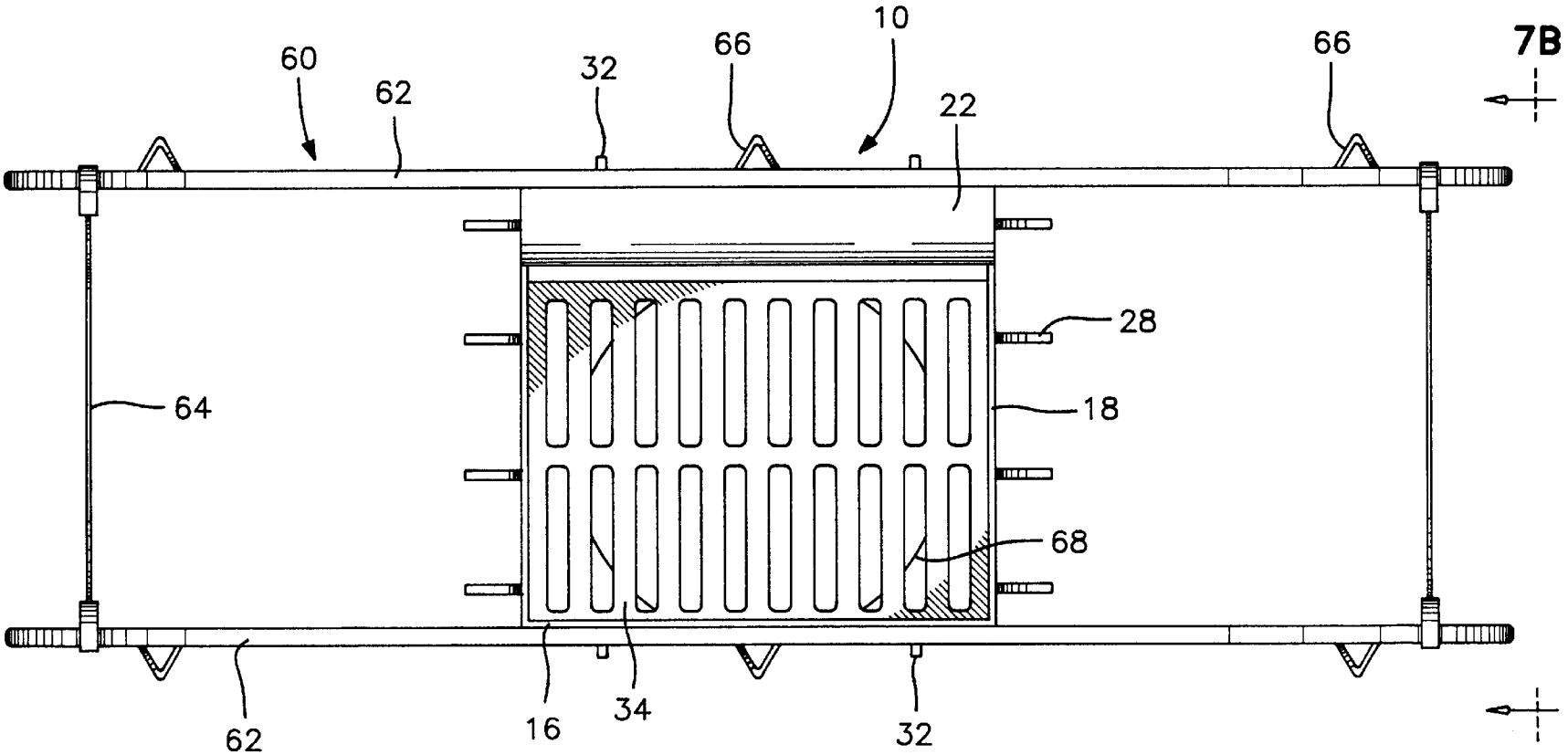
FIG. 7A is a top view of a second alternative construction of the one-piece frame and funnel drain of the present invention, shown with a grate and mounted in a curb and gutter form.
Figure 7B:
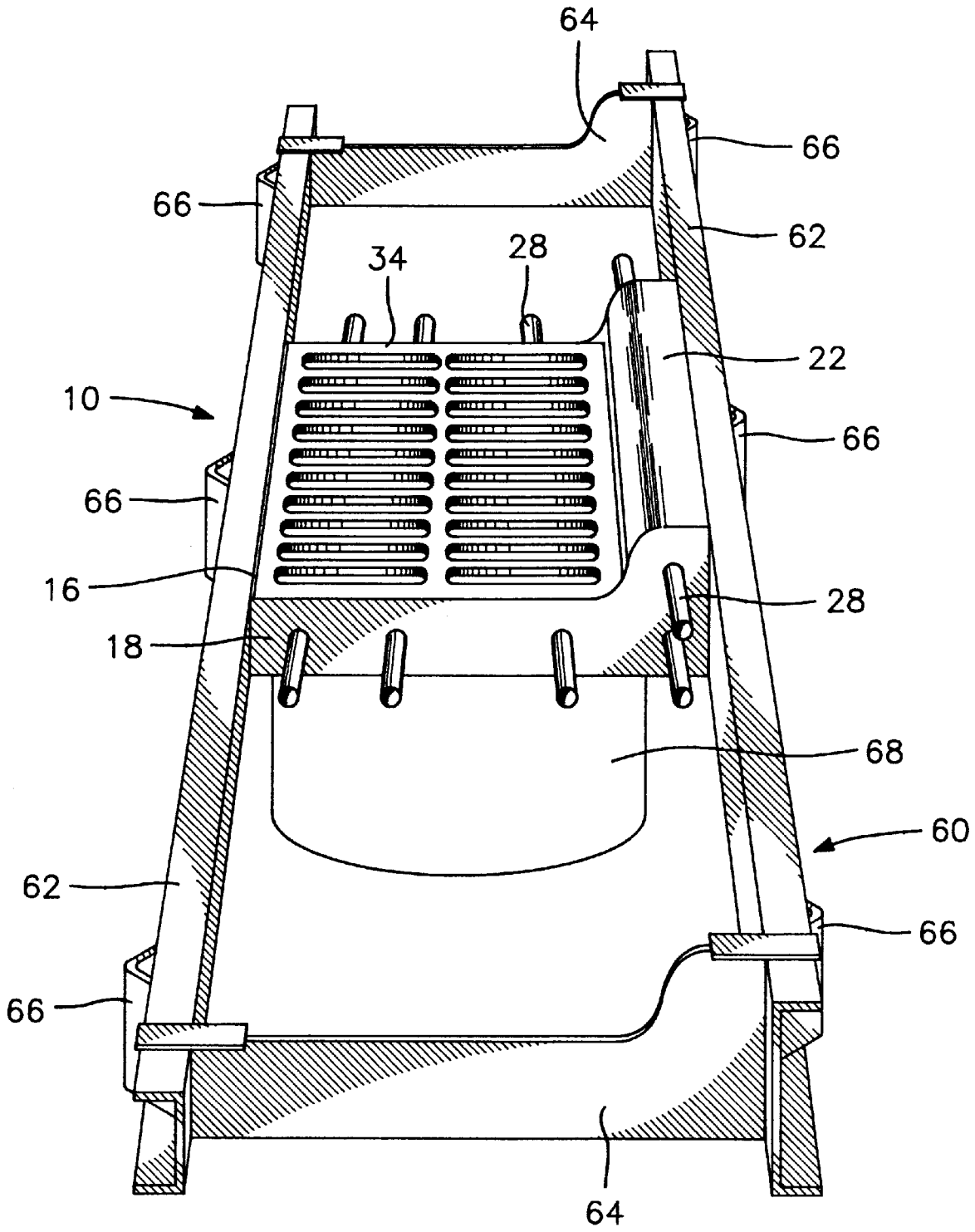
FIG. 7B is a side elevational view along line 7B—7B in FIG. 7A, showing a 900 circular funnel drain designed to fit in the lid of a pre-cast concrete junction box.

A second alternative embodiment is shown in FIGS. 7A–7B. FIG. 7A shows a top view and FIG. 7B shows a side elevational view of the frame and funnel drain 10 with a circular drain 68 as installed in a curb and gutter form, generally designated by the reference numeral 60. The curb and gutter form 60 includes front and rear longitudinal members 62 joined by cutter plates 64. The cutter plates 64 are used to form expansion joints in the poured concrete. The shape of the cutter plates 64 determines the contour of the concrete when it is poured, as further illustrated in FIGS. 14A–C. Before the concrete is poured, the form 60 is anchored to the ground using metal rods or stakes (not shown) through anchor loops 66.

The frame and funnel drain 10 is mounted in the form 60 using the dowels 32 which are inserted through holes in the longitudinal members 62. After the concrete paving 30 sets, the cutter plates 64 are removed and the longitudinal members 62 are pulled outwardly off the dowels 32. The frame is secured to the set concrete paving 30 on either side by the reinforcement studs 28. A grate 34 is placed over the frame 12 to cover the top of the circular drain 68. In this second alternative embodiment, the lower end of the circular drain 68 is designed to fit into a pre-cast concrete box lid 70 for a concrete junction box 72, as shown in FIG. 9.

Figure 8A:
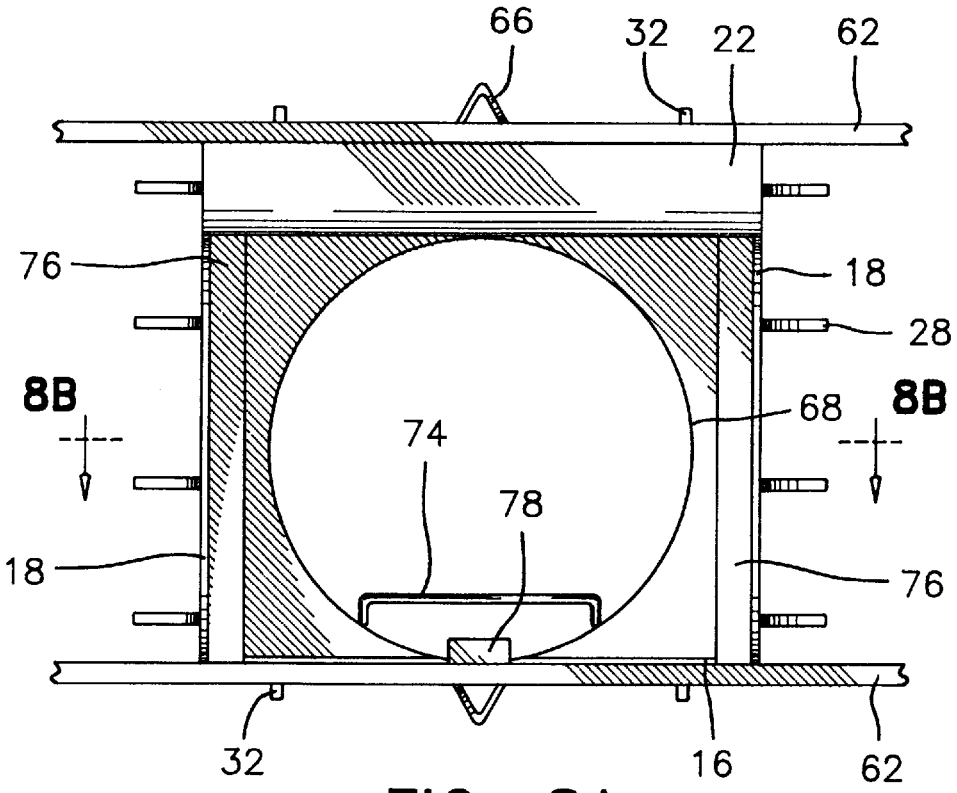
FIG. 8A is a top view of the one-piece frame and funnel drain shown in FIG. 7A, without the grate.
Figure 8B:
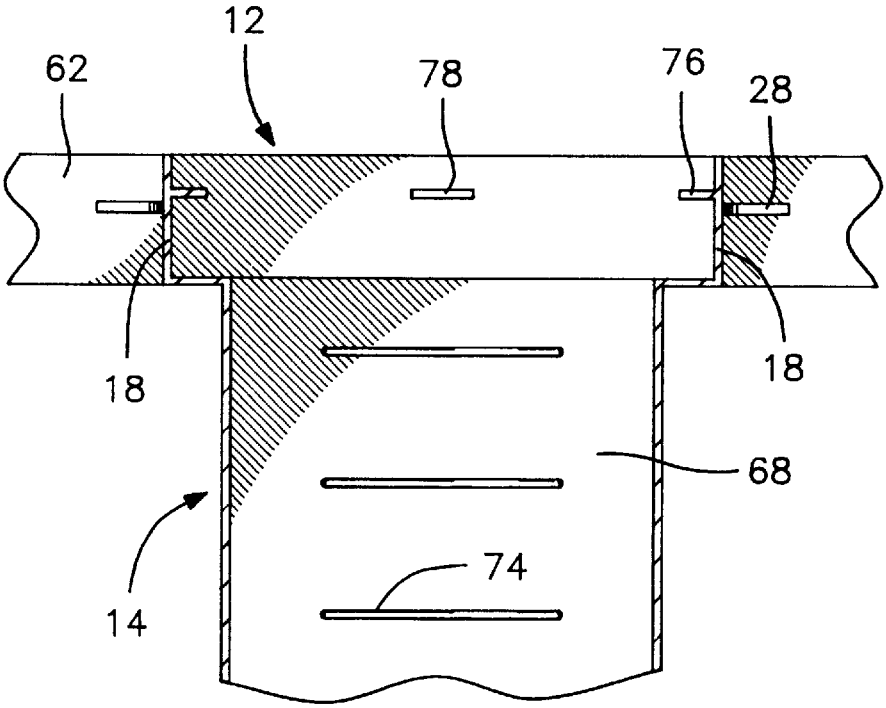
FIG. 8B is a cross-sectional view along line 8B—8B in FIG. 8A, showing the steps on the inner surface of the circular funnel drain.

In FIGS. 8A and 8B, top and cross-sectional views, respectively, of the frame and funnel drain of FIG. 7A are shown with the grate 34 removed. Mounted on the inner surface of the circular drain 68 are preferably a plurality of manhole steps 74. When the grate is removed, these manhole steps 74 allow entrance into the concrete junction box 72 located beneath the drain 68. Side support shelves 76, located on the inner surface of each side panel 18 of the frame, as well as a front support shelf 78 on the inner surface of the front panel 16, support the grate 34 when installed. In a preferred embodiment, each side support shelf 76 includes an upwardly extending rear stop 80 (see FIG. 10) that prevents the grate from moving too far rearward, ensuring that the front edge of the grate remains immediately adjacent the front panel 16 of the frame 12 and supported on shelf 78.

Figure 9:
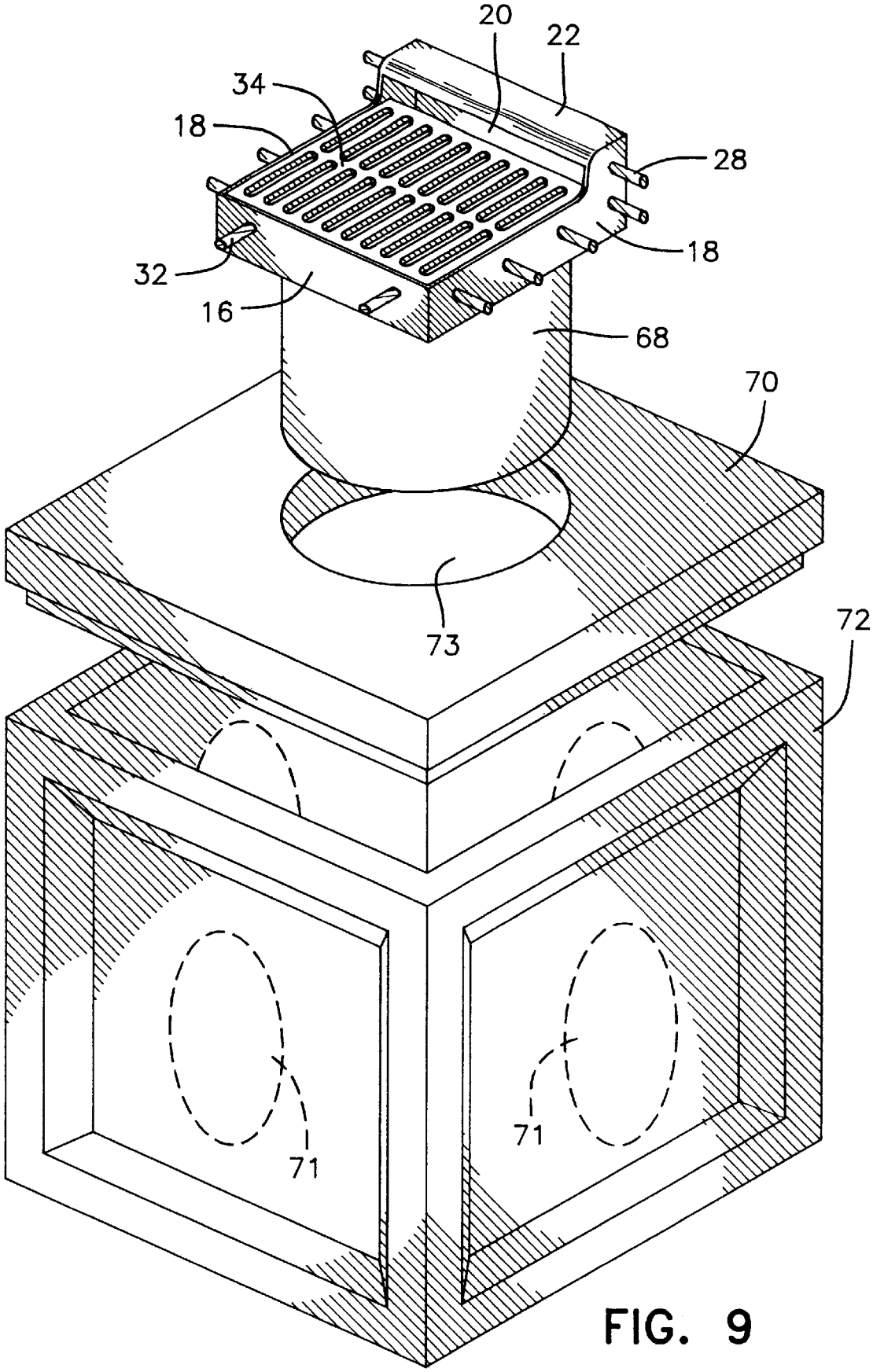
FIG. 9 is a front perspective exploded view of the one-piece frame and funnel drain of FIGS. 7A–7B, with the pre-cast concrete junction box and lid.

FIG. 9 shows a front perspective view of the frame 12 with circular drain 68, according to the second alternative embodiment. As shown, the circular drain 68 is sized to fit within the circular opening 73 of the pre-cast concrete box lid 70 and can be rotated within such lid. This rotational capability allows the present invention to accommodate a curb and gutter arrangement that is not parallel with the concrete junction box 72, offering a significant advantage over the prior art bricked masonry chimney technique. A center area 71 of each of the four sides of the concrete junction box 72 can be punched out to access drain lines from four directions.

Figure 10:
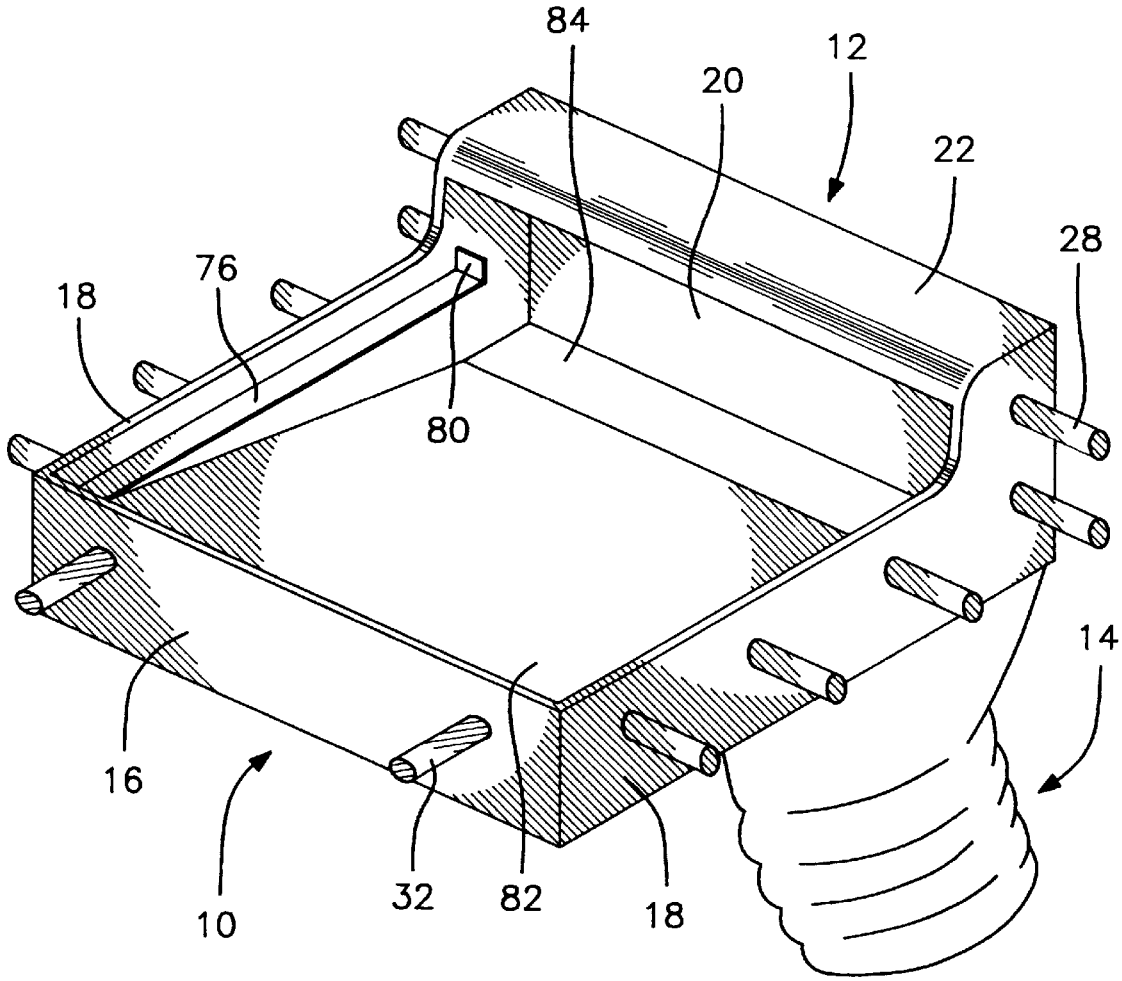
FIG. 10 is a front perspective view of the one-piece frame and funnel drain of the present invention shown in FIGS. 3–5 but without a grate.

Looking now to FIG. 10, a front perspective view of the embodiment of the frame and funnel drain 10 shown in FIGS. 3–5, 10 as adapted for use with a grate, shows the sloped drain surface 82 of the frame 12. When the frame and funnel drain 10 has been installed, the grate 34 is placed over the sloped drain surface 82 and supported on either side by side support shelves 76. The grate is prevented from moving rearward by the upwardly extending rear stops 80. Drainage water flows through the frame drain opening 84, at the rear of the sloped drain surface 82, in the bottom of the frame, where it is directed through the funnel drain 14. The curb hood 22 prevents debris or other materials from falling directly into the frame drain opening 84 from above.

The embodiments depicted in FIGS. 4, 6A–6C and 7A–7B represent three preferred embodiments of the frame and funnel drain 10 of the present invention. In the figures illustrating each of these embodiments, the frame 12 is shown as a 90° 2'6" frame, with the style of the funnel drain 14 varying and thus distinguishing the three embodiments. However, each of the funnel drain styles shown could be paired with an alternative frame style, according to particular need. For example, the sloped and tapered funnel drain 14 of FIG. 4 could be combined with a shoulder berm frame style or with an "S" frame style. Similarly, the extendable rectangular sleeve 50 of FIGS. 6A–6C could be combined with a shoulder berm frame or with an "S" style curb frame, and so on. A particular frame style is selected on the basis of the curb form within which the frame and funnel drain is to be installed, while the choice of drain style is dependent upon the drainage pipe configuration or other considerations. The present invention includes any combination of frame and drain styles, welded together to form a one-piece steel structure. The frame and funnel drain combinations shown herein are thus illustrative only and are intended to demonstrate some of the many constructions that are possible.

Figure 11A:
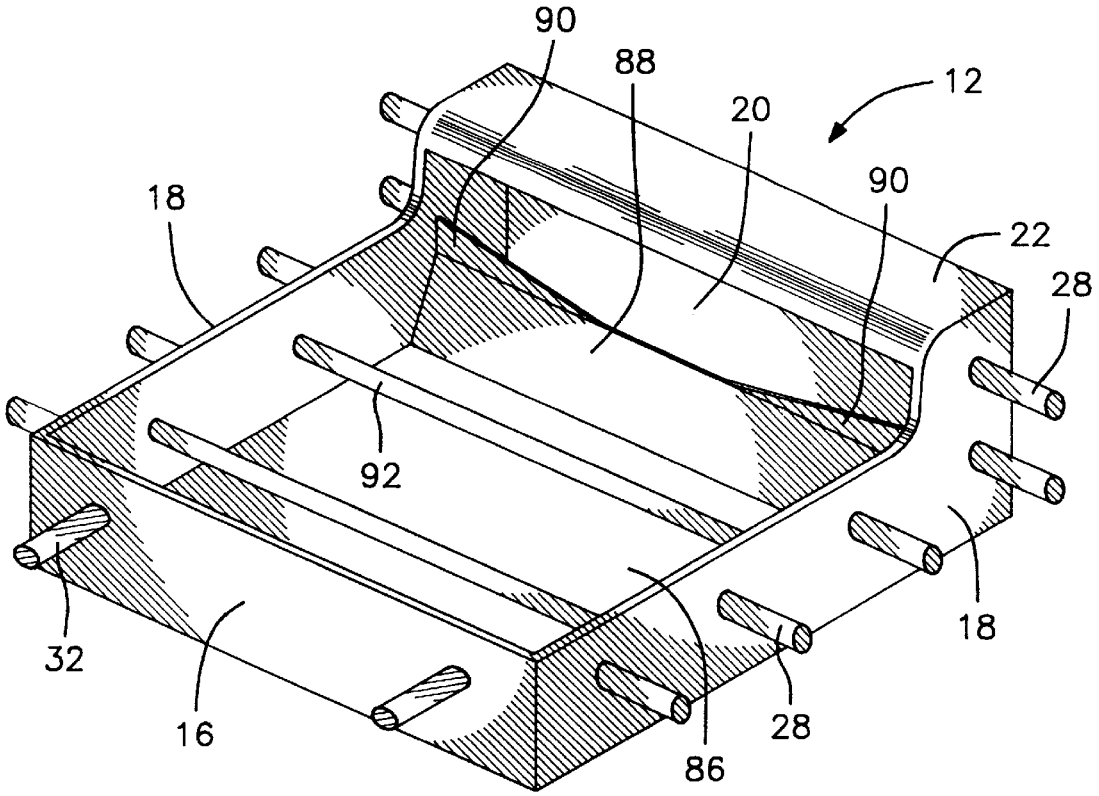
FIG. 11A is a front perspective view of a 90° 2'6" frame style in accordance with the present invention, shown without concrete.
Figure 11B:
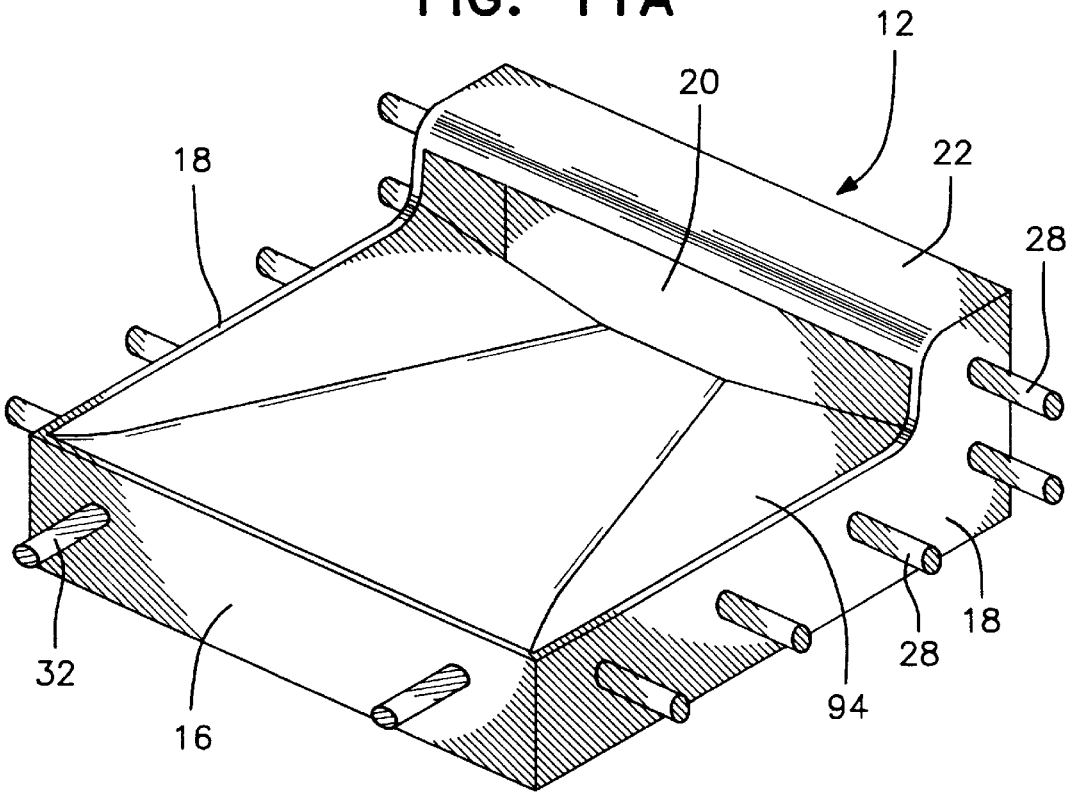
FIG. 11B is a front perspective view of the 90° 2'6" frame style of FIG. 11A, shown with concrete.

Looking in greater detail at particular frame styles, FIGS. 11A and 11B are front perspective views of a 90° 2'6" frame 12 according to the present invention, as constructed for concrete contouring; the funnel drain 14 is not shown. As shown by the frame 12 without concrete in FIG. 11A, the bottom 86 of the frame includes an upwardly and rearwardly extending rear edge 88. On the top of each side of the upwardly extending rear edge 88, there preferably is an upwardly extending fin 90 that abuts the respective side panel 18 and slopes downwardly toward the center of the rear edge 88. A plurality of reinforcement rods 92 extend laterally between the side panels 18. Concrete is poured into the frame and contoured to be flush with the top edges of the front panel 16 and side panels 18, sloping downward toward the middle of the rear edge 88, as shown in FIG. 11B; preferably, the slope is approximately 2:1. The fins 90 ensure a downward slope is achieved from the top edge of either side panel 18 toward the middle of the rear edge 88. The concrete, when set into the contoured concrete drain surface 94, is strengthened by the reinforcement rods 92. When installed, the top edges of the side panels 18 and front panel 16 are flush with the surrounding paving. This allows the water to flow directly into the contoured concrete drain surface 94 from three sides, and also allows wheeled vehicles, including bicycles, to ride over the depression created by the drain surface without losing control. Reinforcement studs 28 secure the frame 12 to the paving. The curb hood 22 matches the shape and curvature of the curb within which the one-piece frame and gutter drain is installed.

Figure 12A:
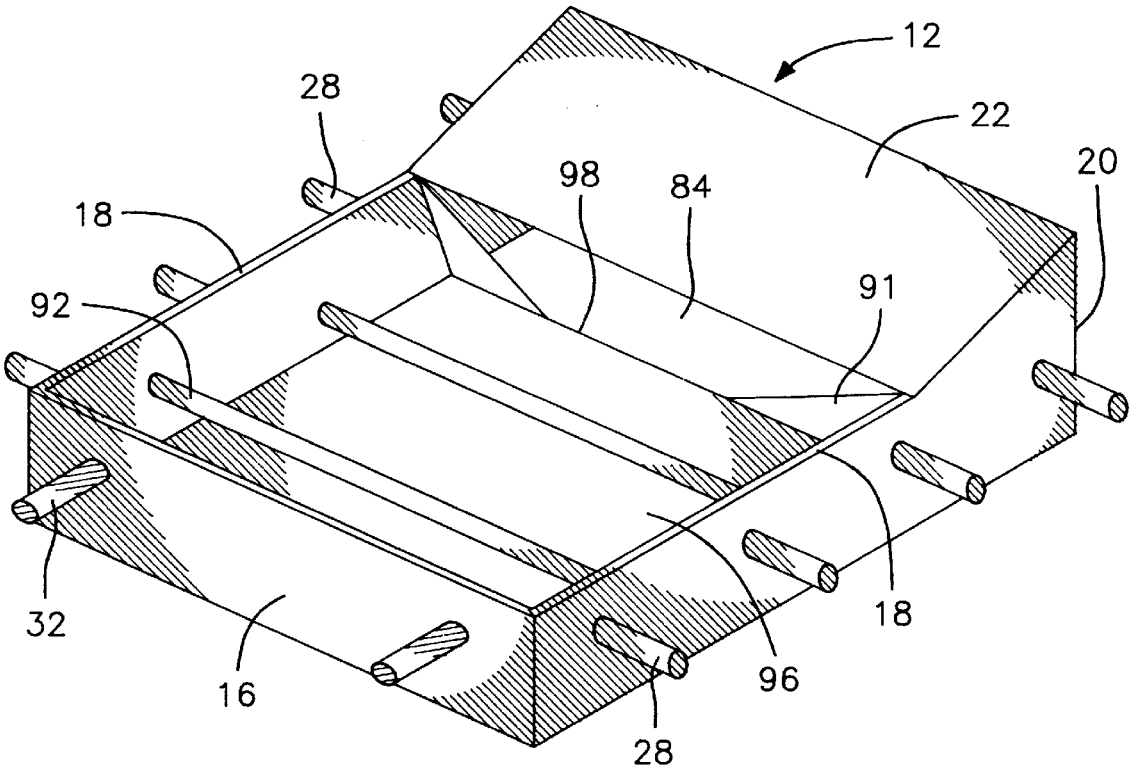
FIG. 12A is a front perspective view of a shoulder berm frame style in accordance with the present invention, shown without concrete.
Figure 12B:
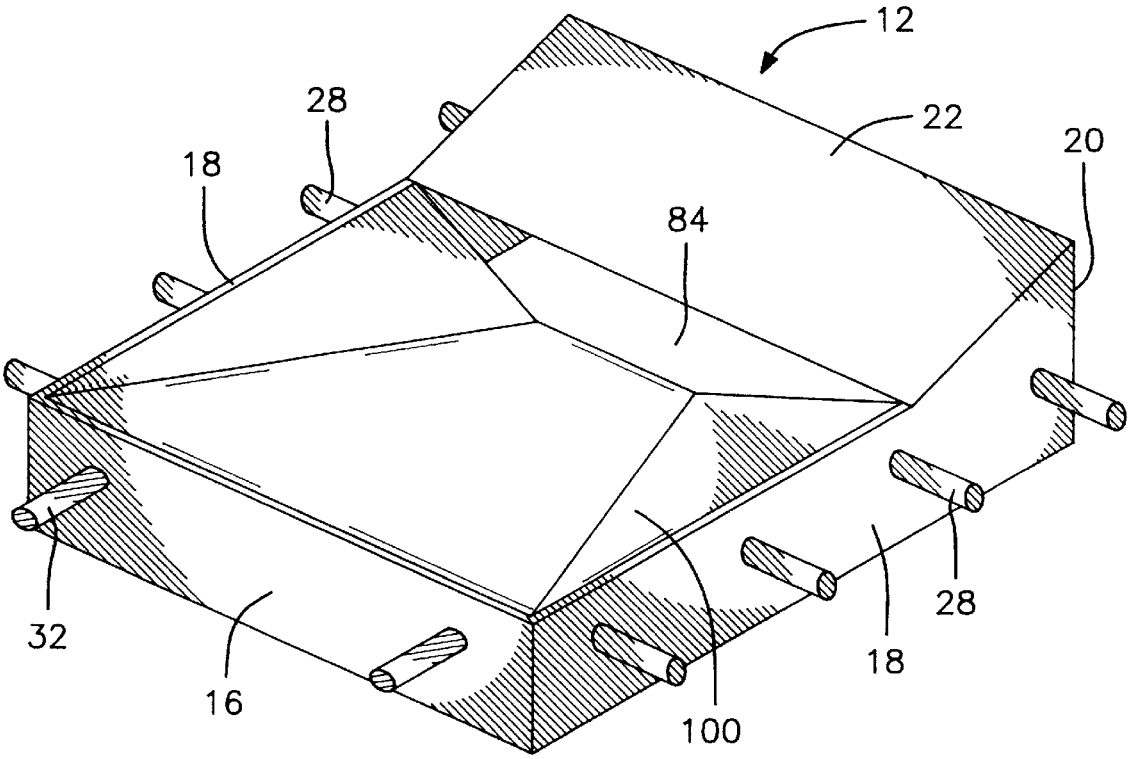
FIG. 12B is a front perspective view of the shoulder berm frame style of FIG. 12A, shown with concrete.

A second frame style in accordance with the present invention for use with a shoulder berm gutter form, as constructed for concrete contouring, is shown in FIGS. 12A and 12B. As shown by the frame without concrete in FIG. 12A, the bottom 96 of the frame is essentially perpendicular to the side panels 18, and has a back rear edge 98 adjacent the frame drain opening 84. On each side of the back rear edge 98, there preferably is an upwardly extending fin 91 that abuts the respective side panel 18 and slopes downwardly toward the center of the rear edge 98. The height of the side panels 18 where they abut the front panel is typically somewhat greater than the height of the side panels at the front edge of the curb hood 22. A plurality of reinforcement rods 92 extend laterally between the side panels 18. Concrete is poured into the frame and contoured to be level with the top edge of the front panel 16, sloping downwardly toward the back rear edge 98, as shown in FIG. 12B; preferably, the slope is approximately 2:1. The concrete, when set into the sloping concrete drain surface 100, is strengthened by the reinforcement rods 92. When installed, the top edges of the side panels 18 and front panel 16 are flush with the surrounding paving. This allows water to flow directly into the sloping concrete drain surface 100 from three sides, and also allows wheeled vehicles, including bicycles, to ride over the depression created by the drain surface without losing control. Reinforcement studs 28 secure the frame to the paving. The curb hood 22 matches the shape and curvature of the curb within which the one-piece frame and gutter drain is installed.

Figure 13A:
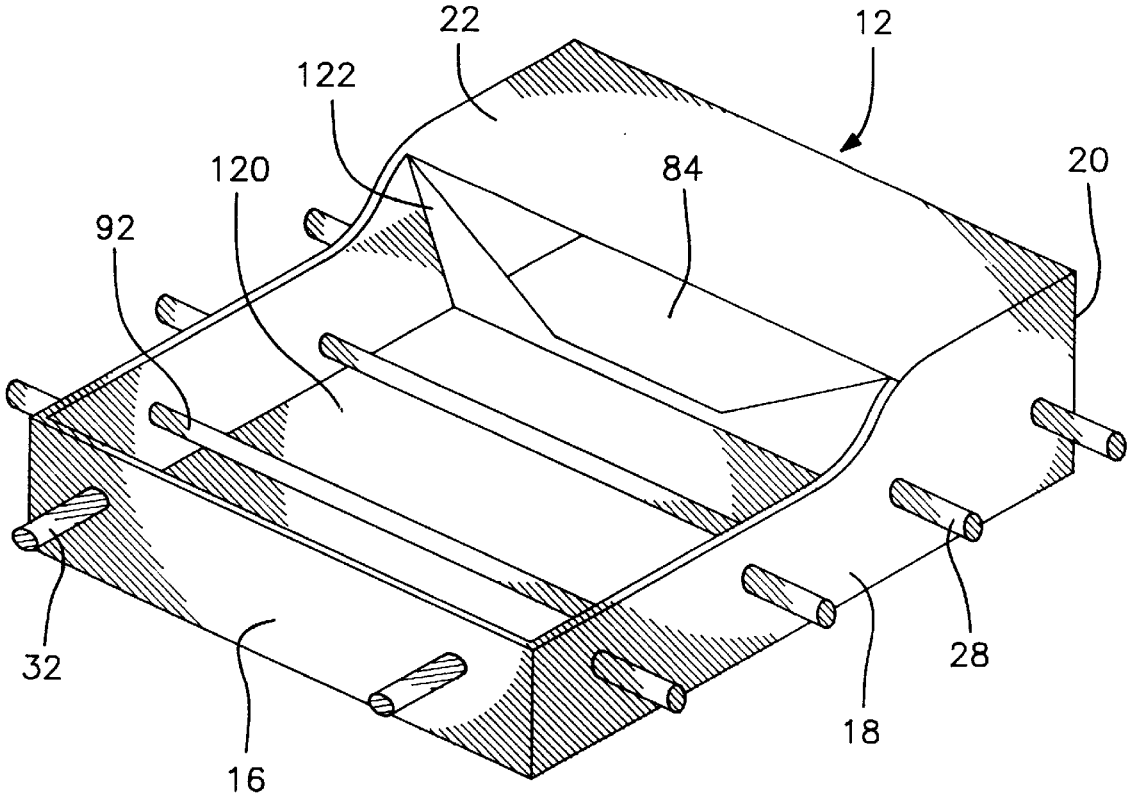
FIG. 13A is a front perspective view of an "S" style transversible curb frame style in accordance with the present invention, shown without concrete.
Figure 13B:
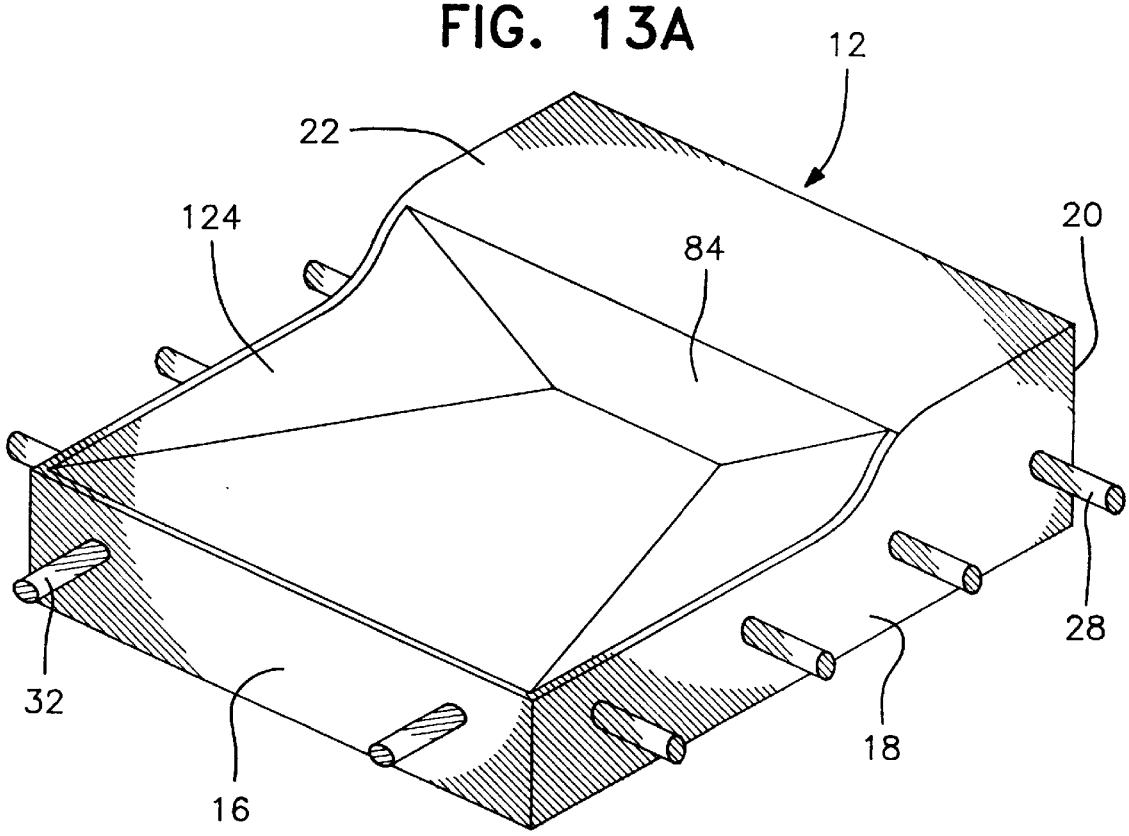
FIG. 13B is a front perspective view of the "S" style transversible curb frame style of FIG. 13A, shown with concrete.

A third frame style in accordance with the present invention for use with an "S" style transversible curb and gutter form, as constructed for concrete contouring, is shown in FIGS. 13A and 13B. As shown by the frame 12 without concrete in FIG. 13A, the bottom 120 of the frame includes an upwardly extending rear edge 122. Near the midpoint between the side panels 18, the top of the rear edge 122 is approximately parallel to the bottom 120 of the frame and has relatively little vertical height. Moving outward from the midpoint toward each side panel 18, the rear edge 122 slopes upwardly so that, when the rear edge 122 abuts the side panels 18, the top of each side of the rear edge 122 is approximately flush with the top edge of the respective side panel 18. A plurality of reinforcement rods 92 extend laterally between the side panels 18. Concrete is poured into the frame and contoured to be flush with the top edges of the front panel 16 and side panels 18, sloping downward toward the middle of the rear edge 122, as shown in FIG. 13B; preferably, the slope is approximately 2:1. The upwardly sloping sides of the rear edge 122 ensure a downward slope is achieved from the top edge of either side panel 18 toward the middle of the rear edge 122. The concrete, when set into the contoured concrete drain surface 124, is strengthened by the reinforcement rods 92. When installed, the top edges of the side panels 18 and front panel 16 are flush with the surrounding paving. This allows the water to flow directly into the contoured concrete drain surface 124 from three sides, and also allows wheeled vehicles, including bicycles, to ride over the depression created by the drain surface without losing control. Reinforcement studs 28 secure the frame 12 to the paving. The curb hood 22 matches the shape and curvature of the curb within which the onepiece frame and gutter drain is installed.

Figure 14A:
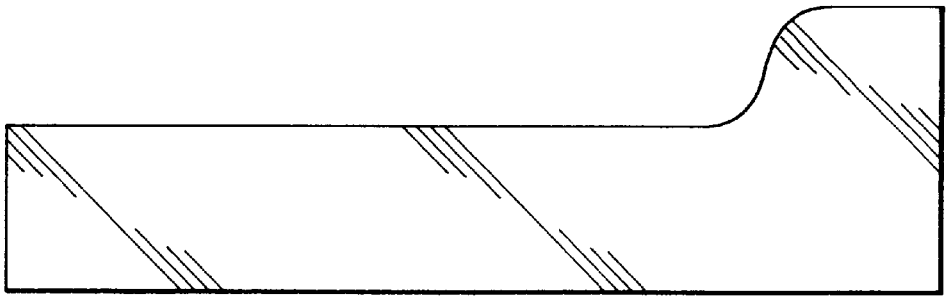
FIG. 14A is a side view of a standard 90° 2'6" curb and gutter form.
Figure 14B:
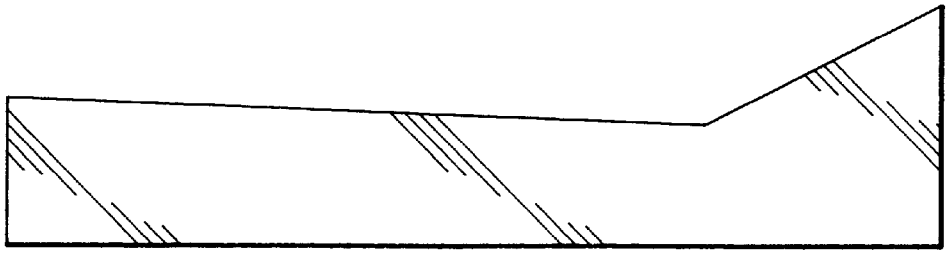
FIG. 14B is a side view of a 36" shoulder berm gutter form.
Figure 14C:
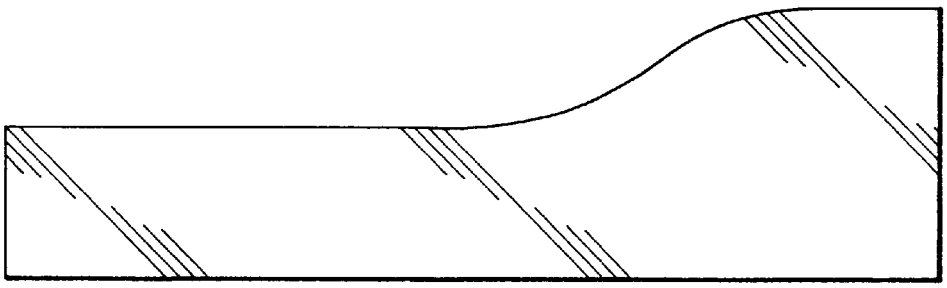
FIG. 14C is a side view of an "S" style transversible curb form.

The three most common curb forms are shown in profile or side view in FIGS. 14A–C. The form in FIG. 14A is a standard 90° 2'6" curb and gutter form and represents the style of curb within which the frame depicted in FIGS. 10 and 11A–11B is intended to be installed. The form in FIG. 14B is a 36" shoulder berm gutter form and represents the style of curb within which the frame shown in FIGS. 12A–12B is intended to be installed. The form in FIG. 14C is an "S" style transversible curb and gutter form and represents the style of curb within which the frame shown in FIGS. 13A–13B is intended to be installed. Other curb styles are also possible and may be easily accommodated through adjustment in frame construction.

To install the curb and gutter one-piece frame and funnel drain 10, the desired curb form 60 is installed to the desired elevation. A hole must be dug into the supporting earth 36 at the desired drain location. Then the one-piece frame and funnel drain 10 is mounted directly in the curb form 60 using the dowels 32, with the funnel drain 14 extending downwardly into the hole in the ground. Once the frame and funnel drain 10 is mounted in the form 60, the concrete paving 30 can be poured by a standard slip form curb and gutter paver. The frame and funnel drain 10 can be mounted directly in the curb form 60 and "paved over" because the side panels of the frame 12 are the same shape as the cutter plates 64 within the curb form 60. As a result, curb and gutter installation and drain pipe installation can be done simultaneously instead of in the two steps that are otherwise necessary to complete the open sections of paving in the portion of the curb that contains the frame.

Once the concrete paving sets, the cutter plates 64 are removed and the longitudinal members 62 are pulled outwardly off the dowels 32. The frame 12 is secured to the set concrete paving 30 by the reinforcement studs 28. Using funnel attachments, such as elbows 46, funnel extensions 38 and saddle fittings 44, the final connection between the funnel drain 14 and the drain pipe 42 can be made then or at a later time.

The foregoing descriptions and drawings should be considered as illustrative only of the principles of the invention. The invention may be constructed in a variety of configurations and is not limited to the configurations shown in the preferred embodiments. Therefore, it is not desired to limit the invention to the specific examples disclosed or the exact construction and operation shown and described. Rather, all suitable modifications and equivalents may be resorted to, falling within the scope of the invention.

What is claimed is:

1. A frame and funnel drain for curb and gutter use, comprising:

a frame having a bottom surface, with a drain opening, and generally vertical front panel, rear panel, and two side panels, a top of said rear panel joined to a generally horizontally inclined curb hood extending toward the front panel, the front panel and the rear panel adapted to fit within a standard curb form and a shape of the curb hood closely approximating a curvature of curb formed using the standard curb form;

a plurality of dowels extending outwardly from the front panel and the rear panel to secure said frame in the standard curb form; and a funnel drain, fixedly connected to an underside of said frame and having access to said drain opening, a lower end of said funnel drain adapted to connect to a drain pipe.

2. The frame and funnel drain as set forth in claim 1, said frame further comprising:

a side support shelf on an inner surface of each side panel; and a grate supported by said side support shelves and abutting inner surfaces of the front and side panels.

3. The frame and funnel drain as set forth in claim 1, said bottom surface of said frame further including an upwardly extending rear edge, said drain opening being behind said rear edge, wherein concrete is poured into said frame and contoured to be flush with a top edge of said front panel and said side panels, said concrete sloping downward toward, and flush with, a center of said rear edge.

4. The frame and funnel drain as set forth in claim 1, said funnel drain extending downwardly from said frame and rearwardly with respect to said curb hood such that a connection between said funnel drain and the drain pipe is in non-vertical alignment with said frame and said funnel drain extends in a direction opposite that of an adjoining road surface.

5. The frame and funnel drain as set forth in claim 4, said funnel drain further comprising at least one of a funnel extension and an elbow fitting for accommodating variation in placement of the drainage pipe.

6. The frame and funnel drain as set forth in claim 1, said frame and funnel drain constructed as a one-piece unit of welded metal.

7. The frame and funnel drain as set forth in claim 1, said funnel drain comprising an extendable rectangular sleeve fitting, said sleeve fitting having an inner portion connected to the underside of said frame and an outer portion connected to the drain pipe, said outer portion sized to receive said inner portion and a depth of insertion of said inner portion within said outer portion being adjustable to accommodate a distance between said frame and the drain pipe.

8. The frame and funnel drain as set forth in claim 1, said funnel drain comprising a circular drain connected to the underside of said frame so as to be approximately perpendicular thereto, a lower end of said circular drain adapted to fit a circular opening in a lid of a pre-cast concrete junction box.

9. The frame and funnel drain as set forth in claim 8, wherein the lower end of the circular drain is rotatable within said lid, allowing said frame and funnel drain to be positioned such that said panels of said frame have a non-parallel orientation relative to sides of said junction box.

10. The frame and funnel drain as set forth in claim 1, wherein the frame and funnel drain are connected by bolts.

11. A frame and funnel drain for curb and gutter use, comprising:

a frame having a bottom surface, with a drain opening, and generally vertical front panel, rear panel, and two side panels, a top of said rear panel joined to a generally horizontally inclined curb hood extending toward the front panel, the front panel and the rear panel adapted to fit within a standard curb form and a shape of the curb hood closely approximating a curvature of curb formed using the standard curb form, said bottom surface of said frame further including an upwardly extending rear edge, a top of each side of said rear edge having an upwardly extending fin that slopes downwardly toward a center of said rear edge, said drain opening being behind said rear edge, wherein concrete is poured into said frame and contoured to be flush with a top edge of said front panel, said side panels, and said fins, the concrete sloping downward toward, and flush with, the center of said rear edge; and a funnel drain, fixedly connected to an underside of said frame and having access to said drain opening, a lower end of said funnel drain adapted to connect to a drain pipe.

12. The frame and funnel drain as set forth in claim 11, said frame and funnel drain constructed as a one-piece unit of welded metal.

13. A frame and funnel drain for curb and gutter use, comprising:

a frame having a bottom surface, with a drain opening, and generally vertical front panel, rear panel, and two side panels, a top of said rear panel joined to a generally horizontally inclined curb hood extending toward the front panel, the front panel and the rear panel adapted to fit within a standard curb form and a shape of the curb hood closely approximating a curvature of curb formed using the standard curb form; and a funnel drain, fixedly connected to an underside of said frame and having access to said drain opening, a lower end of said funnel drain adapted to connect to a drain pipe;

wherein said frame and funnel drain are constricted as a one-piece unit of welded metal.

14. A frame and funnel drain for curb and gutter use, comprising:

a frame having a bottom surface, with a drain opening, and generally vertical front panel, rear panel, and two side panels, a top of said rear panel joined to a generally horizontally inclined curb hood extending toward the front panel, the front panel and the rear panel adapted to fit within a standard curb form and a shape of the curb hood closely approximating a curvature of curb formed using the standard curb form; and a funnel drain, fixedly connected to an underside of said frame and having access to said drain opening, said funnel drain including an extendable rectangular sleeve fitting, said sleeve fitting having an inner portion connected to the underside of said frame and an outer portion connected to a drain pipe, said outer portion sized to receive said inner portion and a depth of insertion of said inner portion within said outer portion being adjustable to accommodate a distance between said frame and the drain pipe.

15. A form for a curb and gutter section having a drain therein, comprising a front edge and a rear edge joined by two cutter plates, a profile of each cutter plate defining a standard curb form, and a one-piece frame and funnel drain unit having two side panels and being mounted between the front edge and the rear edge, each side panel of said frame being generally parallel to said cutter plates and having a profile approximately matching the profile of the cutter plates, and a connecting structure extending outwardly from each side panel to secure said frame and funnel drain unit to adjoining concrete paving.

16. The form as set forth in claim 15, wherein said connecting structure includes a plurality of reinforcement studs.

17. The frame and funnel drain as set forth in claim 15, wherein said funnel drain extends downwardly from said frame and rearwardly with respect to said curb hood such that a connection between a lower end of said funnel drain and an underground drain pipe is in non-vertical alignment with said frame and said funnel drain extends in a direction opposite that of an adjoining road surface.

18. The form as set forth in claim 15, said funnel drain comprising an extendable rectangular sleeve fitting, said sleeve fitting having an inner portion connected to the frame and an outer portion connected to a drain pipe, said outer portion sized to receive said inner portion and a depth of insertion of said inner portion within said outer portion being adjustable to accommodate a distance between said frame and the drain pipe.

19. The form as set forth in claim 15, said funnel drain comprising a circular drain approximately perpendicular to an underside of said frame, a lower end of said circular drain adapted to fit a circular opening in a lid of a pre-cast concrete junction box.

20. The combination of a frame and funnel drain for curb and gutter use and a pre-formed concrete junction box, comprising:

a frame having a bottom surface with a generally circular drain opening, and generally vertical front panel, rear panel and two side panels, the front panel and the rear panel adapted to fit within a standard curb form;

a generally circular funnel drain connected to an underside of said frame; and a pre-cast concrete junction box having a lid with a generally circular opening, a lower end of said funnel drain fitted within said opening said frame and funnel drain constructed as a one-piece unit of welded metal.

21. The combination as set forth in claim 20, wherein the lower end of said circular funnel drain is rotatable within said lid, allowing said frame and funnel drain to be positioned such that said panels of said frame have a non-parallel orientation relative to sides of said junction box.

22. The combination as set forth in claim 20, further comprising a plurality of dowels extending outwardly from said front panel and said rear panel to secure said frame in the standard curb form.

23. The combination as set forth in claim 20, wherein a top of said rear panel is joined to a generally horizontally inclined curb hood extending toward the front panel, a shape of said curb hood approximating a curvature of curb formed using the standard curb form.

* * * * *